United States Patent [19]

Kuehnle et al.

[11] Patent Number: 4,510,225

[45] Date of Patent: Apr. 9, 1985

[54] ELECTROPHOTOGRAPHIC METHOD FOR PRODUCING AN OPAQUE PRINT

[75] Inventors: Manfred R. Kuehnle, New London, N.H.; Ferdinand Martinez, Belmont, Mass.

[73] Assignee: Coulter Systems Corporation, Bedford, Mass.

[21] Appl. No.: 423,021

[22] Filed: Sep. 24, 1982

[51] Int. Cl.[3] ..... G03G 13/16; G03G 13/24

[52] U.S. Cl. ..... 430/126; 430/13; 430/950; 430/952; 430/14; 430/18; 430/124; 430/291; 428/203; 428/206

[58] Field of Search ..... 430/126, 17, 18, 950, 430/952, 13

[56] References Cited

U.S. PATENT DOCUMENTS 2,855,324 10/1958 Van Dom ..... 430/126

4,337,303 6/1982 Shayun et al. ..... 430/13 X

*Primary Examiner*—John D. Welsh

*Attorney, Agent, or Firm*—Silverman, Cass & Singer, Ltd.

[57] ABSTRACT

An opaque reflective print copy is produced by transferring via heat and pressure, an electrophotographically formed toner image to a presoftened transparent thermoplastic thin layer carried bonded to an opaque substrate. The print is formed of at least one generally planar toner image layer embedded in the plastic layer near the outer surface thereof whereby light illuminating the print enters the thin layer and is reflected from the interface between said layer and said substrate, passing through the toner particles as well as being reflected from the toner particles themselves, whereby to provide an image having greater depth intensity and contrast than can be obtained using silver halide photographic film, all without distortion of the image, loss in density or loss in resolution. The substrate may have smooth or roughened surface, and may be selected from plain or coated paper, metal, stone, stretchable and/or inflatable media as well as irregularly shaped objects. Successive toner images may be applied superimposed one on the other in layers and in registry by softening the thermoplastic layer after transfer thereto of one toner image and applying the next toner image thereto. The intermediate heating embeds the toner image and readies the receptor to receive the next toner image.

24 Claims, 7 Drawing Figures

ELECTROPHOTOGRAPHIC METHOD FOR PRODUCING AN OPAQUE PRINT

BACKGROUND OF THE INVENTION

This invention relates generally to electrostatic transfer media for forming permanent print copies of images formed by electrostatic methods and more particularly, provides an opaque image receptor capable of receiving a toner image from an imaged electrophotographic carrier forming an opaque reflective print copy thereof, the toner image being contact transferred to the image receptor and embedded therein by application of heat and pressure, the resulting reflective print copy having substantially increased depth intensity and contrast over use of available silver halide photographic film.

Formation of print copies electrostatically by transfer of toned electrostatic images from an electrophotographic member to a secondary carrier is advantageous in the qualities of speed, in that it employs generally chemically-free procedures, does not require skilled technicians and does not require darkroom or other special conditions and equipment. However, where a photographic quality is sought, the advantages of electrostatic reproduction are offset by the resulting generally poor resolution and the considerable loss in optical density. Edge effect often characteristic of most electrostatic reproduction procedures has reduced the acceptance of electrostatic processes in high resolution print making.

Various processes have been proposed for producing an image upon a substrate, including photographic processes involving actinic exposure of a photosensitive material carried on a substrate or electrostatic process involving exposing a charged electrophotographic member having a photoconductive surface coating or layer to radiation to produce an electrostatic latent image. This latent image is rendered visible by application of dry toner particles thereto as in cascade type development, or by wet application thereto of a liquid toner suspension wherein the toner particles have electrophoretic properties.

The production of suitable print reproductions heretofore commonly requires the skill of a trained technician and the substantial expenditure of money and time. Photographic reproduction processes require controlled exposure, development, washing and fixing of a light sensitive composition present on a support with or without the intermediate production of a negative image.

Photographic reproductions generally are formed by chemically reacting a photosensitive emulsion layer or layers bonded to a substrate or base carrier. Each layer is reacted with the depth of the incremental reactions extending fully through the layer of each layer, where plural layers are involved. With the full thickness of the layer at any one portion of the layer comprising the reacted medium, the image cannot be backlighted or have any backlighted effect. Accordingly, the depth of the resulting image is limited.

Xerographic processes have proven to be an easy and reliable technique for the production of reproductions. Notwithstanding the desirability of these imaging processes, drawbacks have been encountered in forming print reproductions in that the adherence of the image on the transfer support leaves much to be desired. Additionally, some loss of optical density and resolution is experienced upon transfer of the toned image to a receiving member employing prior methods.

Electrophotographic processes require the provision of a suitable image carrier upon which images are formed, these carriers being required to accept an electrical charge and retain the charge sufficiently to enable an image to be formed by application of toner particles thereto. Many materials displaying photoconductivity will not accept a charge initially, and of those which may be charged, few are capable of retaining the charge thereon without leaking off or decaying so rapidly as to be almost useless. In addition to accepting a charge and retaining the charge in darkness, the photoconductive layer is required to discharge in light areas to a degree which is fairly rapid and generally proportional to the amount of light to which the surface is exposed impinging upon the charged surface. Further, there must be retained a discernible difference between the remaining charged and uncharged layers without lateral movement of the charges.

In U.S. Pat. No. 4,025,339, an electrophotographic member is provided with an outer coating of a unique photoconductive material comprising a uniform, microcrystalline, highly ordered, wholly inorganic sputtered deposit having unusual electrical and optical properties particularly advantageous in electrostatic reproduction processes. The patented photoconductive coating is electrically anisotropic, electric anisotropy effectively resulting from the field domain of each crystal forming the coating functioning independently in the charge mode and in the discharge mode without lateral translation to contiguous crystals. Optical anisotropy is believed to be a result of the single crystal activity of the coating.

The uniform vertical orientation of all crystallites defining the photoconductive coating is believed to be a key factor in both the electrical and optical anisotropy demonstrated by the said coating. During toning in the course of the electrostatic reproduction process the toner particles are attracted by myriads of individual fields each having different magnitude individual field strengths, enabling resolution to be achieved which heretofore was unobtainable by then conventional electrostatic reproduction processes.

An electrostatic transfer medium was described in pending application Ser. No. 317,445 filed Nov. 2, 1981 owned by Assignee herein, comprising a transparent polyester sheet having a thin layer of thermoplastic compatible resinous material bonded thereto. The thermoplastic layer had a softening temperature range sufficient to enable toner particles from a toner image on an image carrier to pass thereinto when the layer was heat softened and become embedded. The transfer process there disclosed involved (1) heating the transfer medium sufficient at least to soften the thermoplastic layer and (2) the engagement of the toned, electrostatic latent image-carrier image side down upon the softened coating while pressure, as from a roller, is applied to form a sandwich laminate. The resulting laminate is cooled and then separated into its two component sheets with the result that the entire toned image is transferred intact leaving no residue upon the carrier. The disclosed process was limited to making of transparencies, preferably employing flexible transparent, thin polyester sheets having an affinity for polyester family resins. Full transfer with minimal loss in resolution yet with retention of optical density values was achieved. The substrates were generally smooth, uniformly surfaced sheets on which the thermoplastic polymer was applied. Transfer to less smooth surfaces would greatly enhance the commercial utility of such type processes.

Using conventional electrophotographic processes, it was not possible to form or to transfer toner iamges to surfaces of roughened or irregular surface configuration or to surfaces of stretchable media such as inflatables. It would be of considerable utility to provide a method whereby the transfer of electrostatically obtained toner images could be applied to surfaces independent of their surface configuration and thus provide improvement over the silk screen type processes conventionally employed for such materials.

Electrostatic print reproductions generally have compared unfavorably to photographically obtained print copies in that the former lack the depth, contrast, resolution perceived from the latter type prints. It would be highly desirable to provide print copies using electrophotographic methods but which are even superior to the conventional photographic prints, which have high resolution, improved contrast, depth and intensity, which have a three dimensional effect upon viewing when compared to the conventional photographic print.

Further, considerable product and process advantage would ensue, if in addition to an improved brilliance of image, a process could be provided where one would start with a high resolution, inorganic, reusable photoconductor which would be first toned and whose release properties permit pressure and heat to be applied during contact transfer of the toned image facilitating the full encapsulation of the toner image without detectable lateral image spread or change in density and resolving power on the print as a result of the transfer operation.

SUMMARY OF THE INVENTION

An image receptor for use in forming opaque print copies by contact transfer thereto of an electrostatically formed toner image of a pattern from an image carrier, said image receptor comprising a substrate of opaque material carrying a heat-softenable preferably transparent layer of thermoplastic polymer material bonded to at least one surface thereof, said layer capable of being selectively heat-softened to tackify at least the outer surface fo the layer and then brought into contact engagement with the image carrier. The toner image adheres to the tacky surface. When the image receptor is separated from the image carrier full transfer of the toner image to the outer surface of said layer is effected. The separated image receptor is reheated to resoften the thermoplastic layer whereby the toner particles forming the toner image are fully encapsulated within the softened layer and are embedded in a planar array without detectable lateral spread. The reheating appears to transparentize the toner pigment. The substrate comprises a thin, precoated or uncoated paper, opaque film, wood, stone, ceramic, masonry, metal, an object having a roughened or irregular surface or an inflatable or stretchable medium. The resulting reflective print copy generally is superior to photographic prints.

The invention contemplates making multicolor multilayer reproductions from successive color separations. The transfer is made by superimposing the images successively using heat and pressure and reheating to soften the overcoating carried by the image receptor between each successive transfer.

Since the surface of the opaque substrate is light reflective, the layer preferably transparent and the toner pigments are transparentized during the heating process, light is reflected from the substrate surface, passes through the transparent plastic layer as well as transparentized toner particles, thus doubling the contrast and intensity of the reproduction regardless of density value and provides a pseudo three-dimensional image. The improved quality of the resulting reproduction is especially significant when color toners are employed. The images appear to float at or above the surface of the substrate and within the coated layer. The resulting print copies are much improved over conventional color photographic prints as well as over the conventional black and white photographic prints, and as well, in sharp contrast as compared to print copies obtained by conventional electrostatic processes.

DESCRIPTION OF THE PREFERRED EMBODIMENTS

Figure 1:
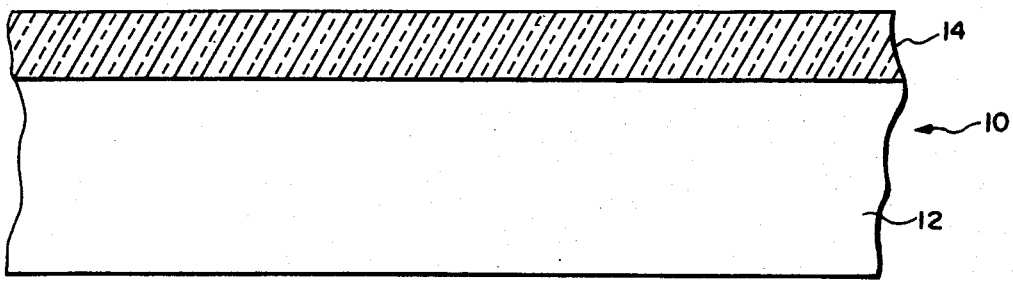
FIG. 1 is a cross-sectional view of the transfer medium constructed in accordance with the herein invention.

The transfer medium or image receptor for forming print copies according to the invention particularly is capable of receiving a toned latent electrostatic image which has been formed upon the photoconductive surface of an image carrier of the type disclosed in the U.S. Pat. No. 4,025,339, owned by Assignee hereof. The image carrier therein described is formed of a substrate having an outer surface coating of a photoconductive material r.f. sputter deposited thereon, said coating consisting of a uniform, vertically oriented, microcrystalline, wholly inorganic, highly dense deposit which is abrasion resistent, possesses unique optical and electrical properties, notably optical and electrical anisotropy, has the capability of being rapidly charged and of holding the applied charge potential at a predetermined charge magnitude level sufficient to enable toning subsequent to exposure to an image pattern of the subject matter to be reproduced. The electrostatic latent charge image of said subject matter is made visible by toning. The optical and electrical characteristics of the photoconductive coating enable unusually high resolution to be achieved in duplicating an image on the image receptor. Conventionally, the toner image is electrophoretically transferred to a transfer medium.

According to the invention, the toned image is dried, or permitted to dry, and is transferred by contact transfer of the toned image to an image receptor, an opaque, imperforate, precoated or plain (uncoated) paper sheet carrying a thermoplastic transparent polymer layer. However, the invention also contemplates selection of a suitable substrate from among other materials such as opaque films, metal sheet, wood, stretchable and/or inflatable media, masonry, stone, ceramics and the like which have a smooth or a roughened surface. The suitable substrate may be flexible or rigid and may have a regular or irregular surface.

A thin layer of thermoplastic polymer material is bonded to a surface of the selected substrate for permanent adherence thereto. The thermoplastic polymer layer is heat-softenable, preferably by application of localized heat using a heated roller to raise the temperature thereof to a value between the glass transition temperature of the polymer layer and the upper extent of the softening temperature range of such polymer layer at a time just prior to bringing the softened layer into pressure engagement with the toned image carrier to tackify the coating. When the tackified surface is brought into contact with the toner image on the image carrier, the toner image is transferred completely from the image carrier to said tackified polymer layer, leaving very little, if any, residual toner on the image carrier.

The image receptor is separated from the image carrier with the toner image being retained on the surface of the layer.

The separated image receptor carrying the toner image again is reheated. During the reheating process, the toner image on the heated image carrier shifts in toto to a location below the surface of said layer without lateral displacement or other distortion of the image. Accordingly, transfer is effected with full retention of image density, to provide a permanent, opaque print copy of the image, said copy having even higher resolution and improved depth of image than heretofore could be obtainable using conventional chemical photographic processes or other electrophotographic imaging processes. The transfer is effected complete, with no pin holes, fractures or other surface defects.

The invention also contemplates multicolor imaging wherein latent electrostatic images are formed successively from color separations onto the photoconductive coating surface of an electrophotographic member, each image being toned with a selected pigmented toner and transferred under heat and pressure successively and in registration to a softened thin thermoplastic overcoat bonded to an image receptor sheet, one toner image pattern superimposed one onto the others forming a multilayered finished reproduction, the receptor sheet being reheated after each transfer to embed each toner image as a planar layer within the thermoplastic layer and ready the receptor for the transfer thereto of the next image pattern.

The selected paper may be calendered or uncalendered. Paper having a thin layer of a thermoplastic resin such as polyethylene or polypropylene bonded to the surface is also well suitable. Preferably, the paper may be from 3 to 12 mils in thickness. The thickness of the resin layer, where present, preferably ranges from about 0.75 to about 2.0 mils.

The principal criteria for selection of a substrate herein is the bondability thereto of the thermoplastic polymer layer and its capability for being heated to the softening range of the said layer.

Other suitable materials from which substrate may be selected include steel sheet, stainless steel, aluminum, stone, wood, masonry, ceramic, rubber and other stretchable materials, including inflatable media. The surface of the suitable substrate may be smooth or roughened. Objects having irregular shapes also may receive the thermoplastic layer so long as its configuration does not prevent the application of heat and pressure just prior, during and after the transfer process.

The transfer medium according to the invention preferably is an opaque, preferably white, substrate to which a thin, 6 to 10 micron thick layer of a thermoplastic resin is applied. A heat stabilizing agent may be compounded within the bulk of the substrate or may be applied as a surface coating, so as to improve dimensional stability and resistance to thermal decomposition at elevated temperatures. Examples of selected opaque substrates include:

Paper—Fortune Gloss-60 and Conso Gloss-40 (Consolidated Paper, Inc.); Warren Flo-70, Patina-70 and Lustro Offset Enamel-70 (Warren)

Polyester Film—ICI, 5 mil, Type 329 (Imperial Chemical Industries), and Dupont, Cronapaque (E. I. Dupont Co.)

Metal Sheet—Rodney-Teledyne Stainless Steel, Type 403; American Litho, Arts, Inc., anodized aluminum plate.

The surface finish of these substrates can range from very smooth to very rough. This property does not have any deleterious effect on the cosmetic quality of the image since conversion of the substrate, by application of a resin coating, produces a receptor sheet with a smooth resin surface to which the toner image is transferred and simultaneously embedded into the resin layer just below the surface thereof to form a planar image.

The preferred polymer compositions suitable for forming the heat-softenable overlayer include thermoplastic resins such as polyester, polyacrylate, polyvinyl buryral, polyvinyl formal, polyvinyl acetate, copolymers of vinyl acetate-vinyl chloride, copolymers of vinylidene chlorideacrylonitrile, or may comprise polyethylene or polypropylene resins. Compatible blends of these polymers with other polymers of different chemical composition such as modified phenolics such as Bakelite CKM 2400 manufactured and sold by Union Carbide Corp. under its registered trademark BAKELITE; polyicetones such as Krumbhaar K1717B, manufactured and sold by Lawter Chemical Co. under its trademark KRUMBHAAR; and resin esters such as floral 105 manufactured and sold by Hercules Co. under its trademark FLORAL are also believed suitable.

Polyesters—Dupont 49000 and 49029, 10 weight percent solutions in cyclohexanone or 2-ethoxyethyl acetate.

Polyester Copolymers—Goodyear Vitel PE-200, PE-222, VPE-4583A, VPE-5545A and VPE-4833A, used either singly or as two components blends, 10 weight percent solutions in cyclohexanone or 2-ethoxyethyl acetate or 80/20 toluene/methyl ethyl ketone.

Polyacrylates—Rohm & Haas Acryloids B-44N, 10 weight percent solution in 85/15 toluene/methyl cellosolve; B-48N, 10 weight percent solution in toluene; B-72, 10 weight percent solution in toulene.

Polyvinyl Butyral—Monsanto B-76, 5 weight percent solution in 2-35 hoxyethyl acetate.

Polyvinylidene—Acrylonitrile copolymer. Dow Saran F 310, 10 weight percent solution in 2-35hoxyethyl acetate.

Polyvinyl acetate—vinyl chloride copolymers Union Carbide Type VYNS, 10 weight percent solution in cyclohexanone; Type VYHH, 10 weight percent solution in 1/1 methyl ethyl ketone/toluene.

Polyvinyl Acetate—Union Carbide Corp. Three different types differing in molecular weight, hardness and softening point (100° C., 125° C. and 150° C.), 10 weight percent solutions in cyclohexanone.

Polyethylehe and Polypropylene—The applicability of these resins has been demonstrated using two different types of 4.4 mil thick schoeller paper (Schoeller Technical Papers Inc.), coated with a 2.0 mil layer of either polyethylene or polypropylene by the manufacturer. Although the resin thickness is more than two times that of the polyester coatings, no deleterious effect on image transfer efficiency, toner embedment or image quality occurs.

All of the resins listed above, with the exception of polyethylene and polypropylene, may be applied as solutions to the substrate using conventional methods that include reverse roll, extrusion, meniscus or dip coating. The preferred methods are reverse roll and solution extrusion. Polyethylene and polypropylene, however, require special equipment for solvent-free extrusion of the molten resins onto the substrate.

The suitable resins are selected from thermoplastic polymers having softening point ranges from a low of 97° C. to a high of about 150° C. The preferred glass transition temperature of the suitable resins is not lower than +30° C. and preferably is in the range +30° to −48° C. These polymers do not evidence any tendency to adhere subsequently to other coated sheets, i.e., to form a "block" after the coating is completed and the polymer layer freed of residual solvent. Solvents such as methyl ethyl ketone, cyclohexanone and cellosolve acetate are suitable.

Referring to the drawing, in FIG. 1, an image receptor according to the invention, is designated generally by reference character 10 and comprises a substrate 12 formed of plain paper, that is, noncalendered or otherwise coated; and, a thin layer 14 of a polyester based thermoplastic polymer resin selected from a group manufactured and sold under the trademark VITEL by the Goodyear Tire and Rubber Co. of Akron, Ohio.

A solution formed of Vitel VPE 5833A resin is coated upon the paper substrate 12 using conventional coating methods to comprise a layer about 4–8 microns in thickness.

Similarly, a solution which comprises of a blend of three (3) parts Vitel PE 222 and one (1) part Vitel VPE 5545A resins (by weight) is coated upon the paper substrate 12 in substitution for the VPE 5833A to a like dry layer thickness. A small amount of Fluorad F430 wetting agent is included in both compositions.

Selected physical characteristics of these three polyester resins employed include:

| | PE 222 | VPE 5545A | VPE 5833A |
|---|---|---|---|
| specific gravity | 1.25 | 1.22 | 1.25 |
| acid number | <5 | <5 | <5 |
| glass transition temp. | +47° C. | −11° C. | +48° C. |
| softening point ring and ball | 151° C. | 98° C. | 97° C. |

Figure 2:
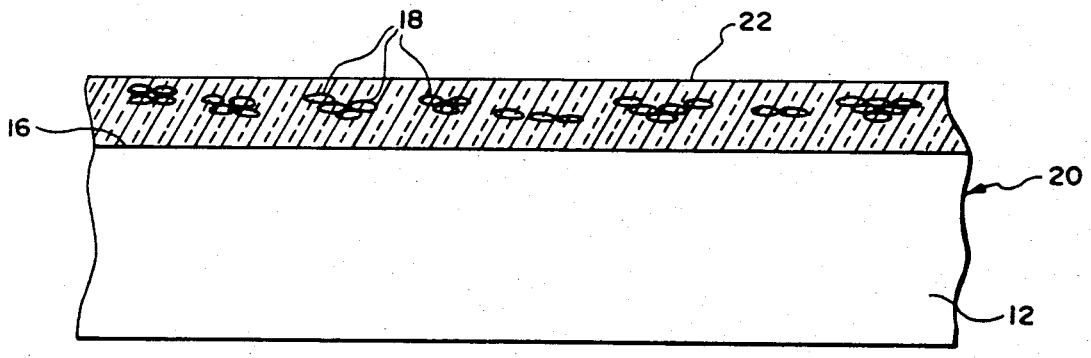
FIG. 2 is a view similar to that of FIG. 1 but showing the transfer medium subsequent to transfer of a toned image thereto and functioning as a finished print reproduction.

In FIG. 2, the completed print reproduction formed on the image receptor 10 is represented by reference character 20 and comprises the substrate 12, the thermoplastic layer 14 bonded to one surface 16 of the substrate and toner particles (pigmented particles) 18 arranged in a pattern forming the transferred image and embedded below the outer surface 22 of said thermoplastic layer 14.

Figure 4:
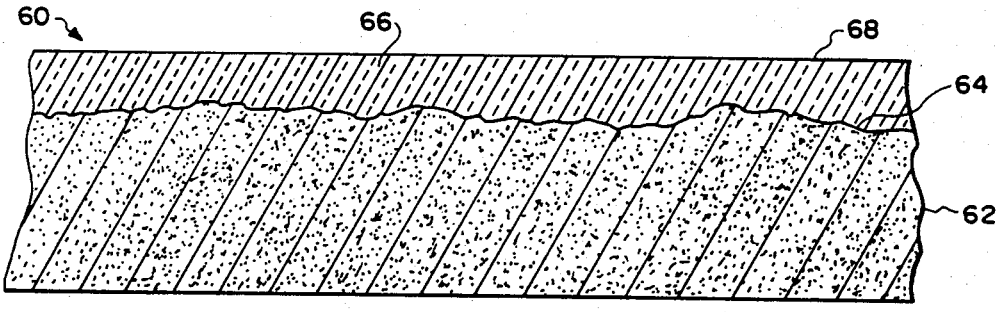
FIG. 4 is a cross-sectional view of a still further modified embodiment of the invention.

In FIG. 4, a further modified embodiment of the image receptor according to the invention has been designated generally by reference character 60 and consists of a substrate 62 which is selected from stone ceramic, or even metal, having a surface 64 which is of roughened configuration. A thermoplastic polymer resin coating composition having a formula as follows:

10 parts Saran F310, a copolymer of vinylidene chloride and acrylonitrile manufactured and sold by Dow Chemical Co. under its registered trademark SARAN;

90 parts cellosolve acetate (2-ethoxyethyl acetate), a solvent manufactured and sold by Union Carbide Corp.

0.004 parts Fluorad F430 manufactured and sold by Minnesota Mining and Manufacturing Co., as a wetting agent, are applied to the surface 64 to form a heat-softenable layer 66 on said roughened surface 64. The outer surface 68 or said substrate 62 is smooth so as to facilitate the transfer of a toner image thereto. Where the image receptor is bulky in configuration, the heating is performed in a suitable heating station (not shown) and the toner image carried by the electrophotographic member is transferred by bringing the said member into engagement with the tackified layer 66 say by use of a roller (not shown) engaged on the said electrophotographic member, or by employing a press or by sealing the member and image receptor in a mold.

Figure 5:
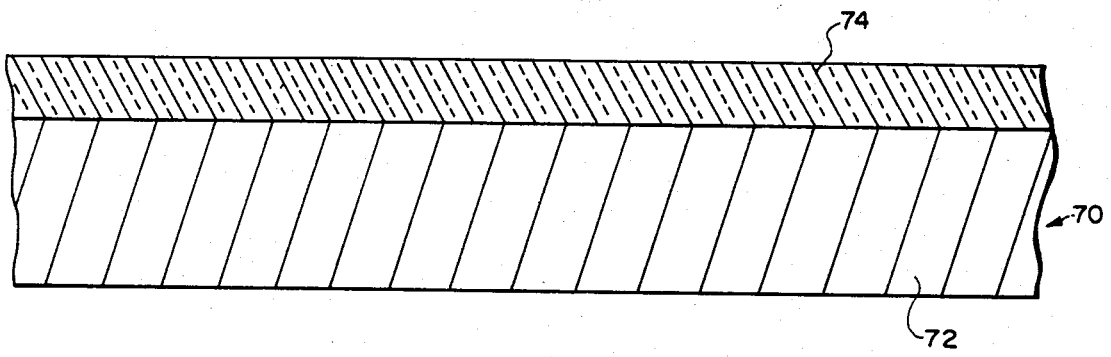
FIG. 5 is a representation of an additional modified embodiment of the invention, here the substrate being sheet metal.

In FIG. 5, a further modified image receptor 70 is illustrated and comprises a metal sheet substrate 72 carrying a layer 74 of thermoplastic polymer bonded thereto. The process for using the image receptor 70 is substantially the same as described in respect of the image receptor 10 except that the softening temperatures employed are not limited by the characteristics of substrates such as paper and the like, and hence may be higher than the softening temperatures feasible with such paper etc. substrates.

Figure 6:
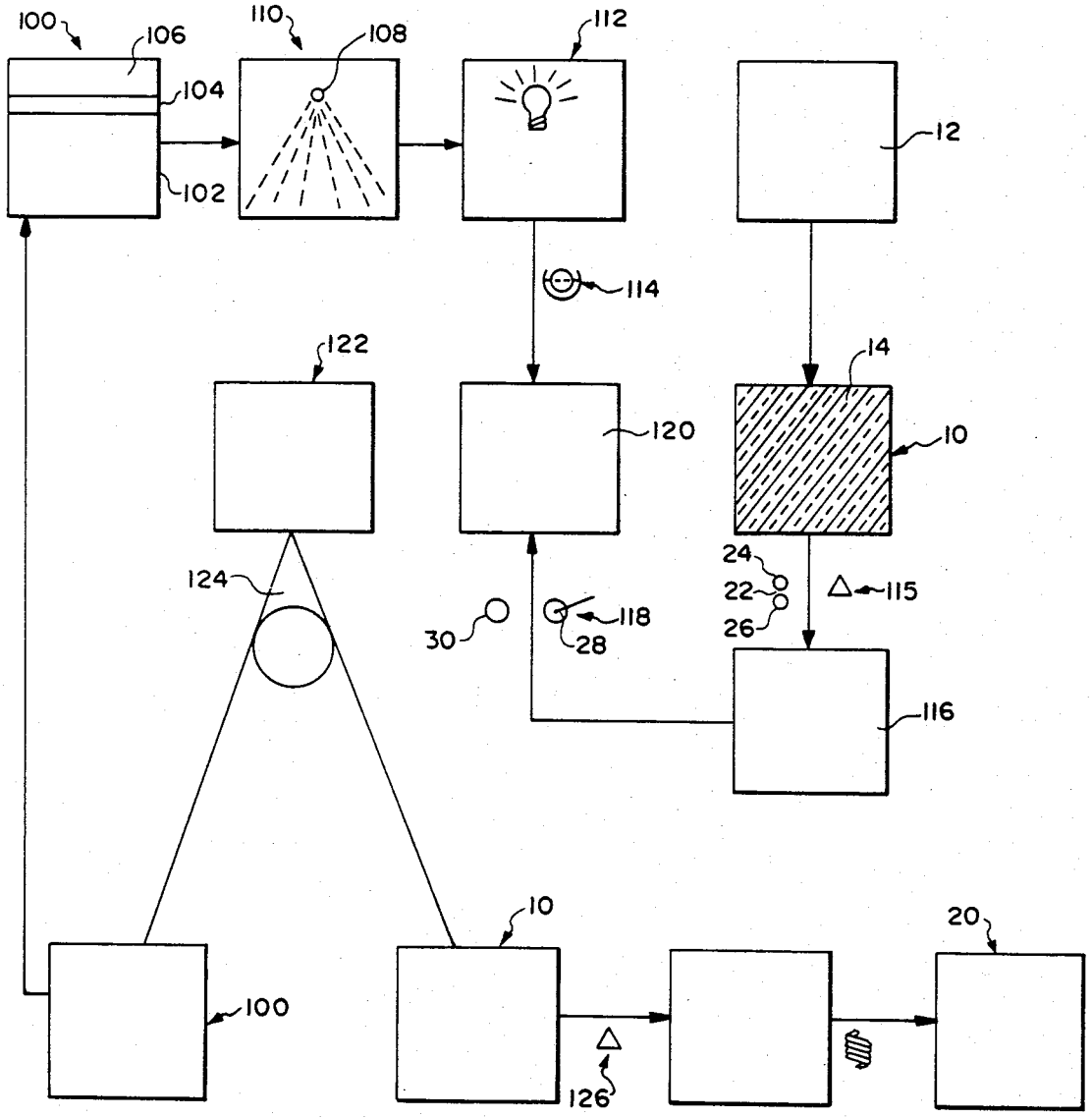
FIG. 6 is a flow diagram illustrating the method of making a finished print reproduction according to the invention.

The flow diagram of FIG. 6 diagrammatically illustrates the process of imaging and transfer in accordance with the invention.

An electrophotographic member 100 of the type described in U.S. Pat. No. 4,025,339 comprises a substrate 102 (formed of metal or polyester polymer such as Mylar, T. M. DuPont Co.), an ohmic or conductive layer 104 and an r.f. sputtered microcrystalline, wholly inorganic photoconductive layer 106 on the ohmic layer. The member 100 is charged by corona device 108 to a predetermined electrostatic surface charge potential at a charging station 110. The charged member is brought to exposure station 112 and an image of a pattern desired to be reproduced is projected upon the charged surface to form a latent electrostatic charge image of said pattern.

The member 100 carrying the latent electrostatic charge image is brought to a toning station (represented by reference character 114) whereat the image is rendered visible by applying toner in a liquid suspension thereto at station 114 forming a toner image. The toner image is dried by evaporation of the suspensing medium.

In the meantime, an image receptor 10 according to the invention is formed by coating a selected substrate 12 with a thermoplastic polymer to form layer 14 thereon. A wetting agent should be incorporated in the coating composition to facilitate the coating process and materially reducing the likelihood of pin holes, crazing, striating and other defects encountered in the coating process. The Fluorad product serves such purpose.

The image receptor 10 is heated at a heating station 114 to reach a surface temperature of about 5°–15° C. above the softening point of the polymer forming layer 14, for example, using Goodyear Vitel VPE 5833A, softening point 97° C., a surface temperature of 102° C. is adequate, the image receptor 10 carrying the softened layer 14 being represented by reference character 116.

The image receptor 10 carrying the softened layer 116 is brought into engagement with the image carrier member 100) at a station represented by reference character 118.

The receptor 10 and carrier 100 are separated with the toner particles 16 making up the toner image adhering preferentially to the tacky surface of layer 14 for full transfer to said layer 14 of image receptor 10. The image carrier is returned to its initiate condition and is reusable as an electrophotographic imaging medium.

The image receptor 10 having the toner image on the surface of layer 14 is reheated at reheating station 124 to a temperature of about 105° C. This station may consist of an enclosed, heated zone such as an oven. In the course of such reheating, the layer 14 is softened sufficiently to enable the toner particle to become embedded below the surface of the layer 14 in the same relative arrangement as originally impressed on the layer 14. The toner image is planar and is located just below the surface of the layer 14. Simultaneously the toner particles are transparentized. Each planar layer constituting a toner image of the multi-image print generally is about 0.5 microns $|\mu|$ in thickness. After reheating the image receptor 10 is cooled positively or permitted to cool as represented by reference character 128.

The heating can be performed by passing the image receptor 10 through a nip 22 defined between a heated roller 24 formed of heat conductive material and a backup roller 26 formed of insulative material.

Immediately subsequent to softening of the polymer layer 14, the image receptor 10 is brought together with the toned electrophotographic image carrier. The tackiness of the heated layer 14 causes the toner particles 18 comprising the toner image to adhere to said softened layer 14 of the image receptor 10 with greater affinity than for the photoconductive surface 106 of the image carrier 100. When the toner image is adhered to the polymer layer, practically no residue is left on the photocnductive surface 106 of said image carrier 100. A positive cooling step may be performed by thermoelectric cooling or the like. Carrier 100 is separated from receptor 10.

Photographic color processing of the silver halide emulsion type results in a color print consisting of superimposed color or dye images in emulsion layers, each layer representing a color separated image. The colors that appear to the viewer of a color print are those reflected back to the eye from white light falling on the print. The innermost layer is formed directly on the backing sheet or substrate. For example, a blue spot appears blue because the magenta and cyan dyes in the emulsion layers absorb both red and green wavelengths from the incident white light, with only blue being reflected. The dyes in the emulsion layers are chemically converted to extend through the full thickness of the respective emulsion layer.

Figure 3A:
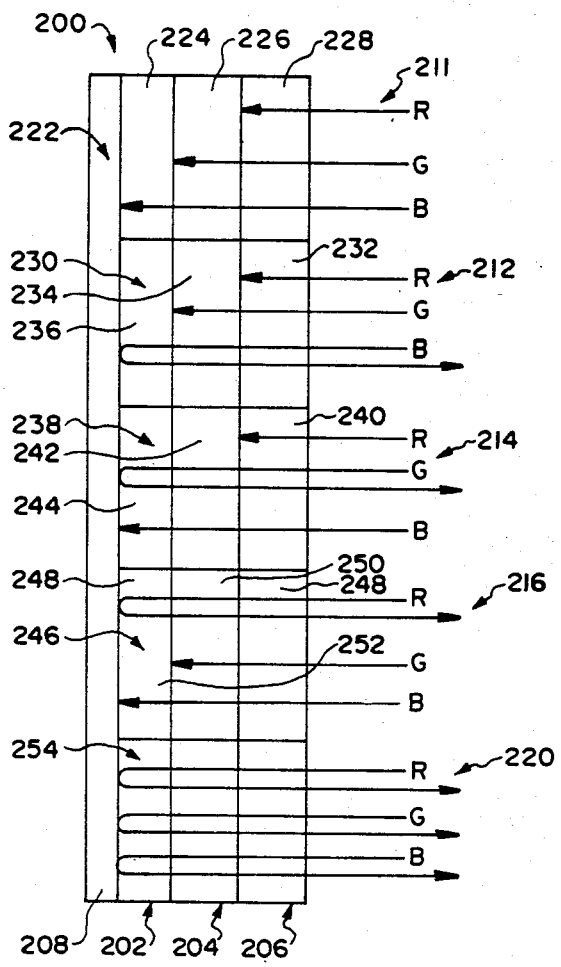
FIGS. 3A and 3B are diagrammatic representations illustrating the light behavior of a conventional photographic (silver halide type) print and of a multicolor multilayer reflective print formed in accordance with the invention respectively.

This process is represented graphically in FIG. 3A wherein the color print 200 consists of layers 202, 204 and 206 respectively representing dyes which absorb blue, green and red respectively, in superimposed layers on base 208. White light beam 211 has red, green and blue ray components. Similarly, white light beam 212, 214, 216, 218 and 220 also are formed of the same color components. Light beam 211 strikes the imaged portion 222, which consists of light activated reacted areas 224, 226 and 228. All color components of beam 211 are absorbed by portion 222. Image portion 230 comprises the activated areas 232 and 234 respectively absorbing red and green, but since the are 236 of emulsion layer 202 was not photonically activated, the otherwise absorbed blue component is reflected back from the base, resulting in perception of blue color by the viewer when beam 212 is incident on portion 230. Image portion 238 consists of activated red and blue absorbing portions 240, 244 with intermediate portion 242, normally absorbing green, nonactivated. Hence the green component of beam 214 is reflected from base 208 passing through both portions 240 and 244 so as to appear green to the viewer. Image portion 246 consists of activated portions 250 and 252 With unactivated normally red absorbing portion 248 nonactivated Only the red component of beam 218 is reflected back from base 208. In portion 254, no portions of layers 202, 204 and 206 are activated so that all components of white light beam 220 are reflected, the resulting appearance being white.

However, the finished print copy formed according to the invention has planar images, especially when layered, just below the outer surface of layer 14. The print has high gloss, high resolution and an absence of any relief pattern. The opaque substrate 12 is light-reflective while the polymer layer 14 carried by substrate 12 preferably is clear and transparent. Reheating of the receptor 20 also is effective to make the toner particles transparent.

Figure 3B:
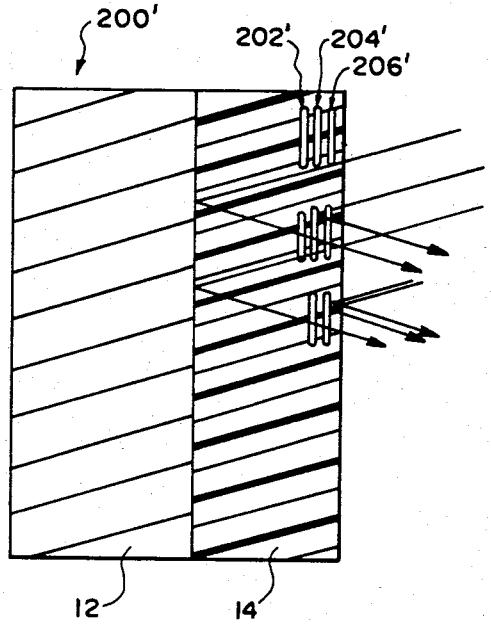

Referring to FIG. 3B, a graphical representation of the reflective print 200' is formed in accordance with the invention, particularly by superimposing successive color separated images represented by toner particle layers 202', 204' and 206' applied in registry one upon the other. The print 200' consists therefore of an opaque substrate 12 and transparent polymer layer 14, the interface thereof being reflective. The image layers 202', 204' and 206' each consist of individual planar toner particles embedded adjacent the outer surface of said layer 14. The image layers are each about 0.5 microns ($\mu$). Each of the layers respectively is similar in light-reflecting, light-absorbing characteristics to the layers 202, 204 and 206 of the photographic color print 200. However, because of the extreme thinness of the planar toner particles, there is a great amount of the transparent polymer layer 14 without any color absorbing particles, as the normal thickness of said layer 14 is about 125 microns ($\mu$). Now, as represented in FIG. 3B, when light beams are incident upon the reproduction 200', some of the beams will enter the clear resin, pass to the interface between opaque substrate 12 and layer 14 and back-light the respective toner images. The pigmented particles in their relatively planar configuration, being also transparentized, receive and reflect the light rays and also enable the passage therethrough of the rays reflected from the interface. Thus, the planar toner or pigmented particles making up the image appear to be floating and are effectively backlighted, giving rise to a pseudo three-dimensional appearance. This results in greater intensity or contrast of the image reproduced.

The apparent depth of image without loss in contrast and/or resolution appears to be greater than that obtained according to conventional photographic processes and is a unique and unobvious result of the practice of the herein invention.

In viewing, light is passed through the transparent polymer layer 14 and the superimposed layers of transparentized toner particles to the interface of layer 14 and substrate 12 and is reflected in a diffused manner back through said planar toner particles, increasing the intensity and furnishing brilliance and depth to give to the viewer a pseudo three-dimensional image, regardless if the toners employed are black or are color toners. The image appears to be "freely floating" in the layer 14. This is particularly effective where paper or opaque white film substrates are employed.

In addition to the brilliance of the resultant image, unusually high resolution is obtained, taking advantage of the high resolution capable of being achieved using the electrophotographic member disclosed in U.S. Pat. No. 4,025,339. It is important using the process according to the invention, the electrophotographic member can be reused since transfer of the toner image therefrom is complete with no residual toner remaining thereon after transfer. The smooth surface of the polymer layer and the relatively high melting point provide release properties to permit pressure and heat to be applied to the image receptor 10 facilitating the complete encapsulation of the high resolution toner image in the polymer layer 14 without any detectable lateral image spread or change in optical density and resolving power levels on the reflective print as a result of the transfer operation.

By way of specific examples:

EXAMPLE 1

An electrophotographic member comprising a substrate carrying a photoconductive coating applied thereto in accordance with the teachings of U.S. Pat. No. 4,025,339 is charged with a negative corona exposed to the image pattern of an original document projected thereon and toned with a selected toner. If the toner employed comprises a suspension of toner particles in an insulating liquid, a drying step may be required so that a dry toner image is produced.

A sheet of plain paper to which has been bonded a 125 micron ($\mu$) thick layer (in dry state) of a thermoplastic polyester resin 14 composition of the following formulation:

10 Parts VPE 5833A
90 Parts Cyclohexanone
0.004 Part Fluorad F430 was coated from a solvent solution thereof having 10% solids. The solvent is evaporated to leave the layer of resin bonded to the paper. The thermoplastic polymer-coated paper 12 carrying the resin layer (14) was heated to a surface temperature between 97° and 101° C., the softening temperature of the polymer layer 14, for a duration of 5–10 seconds to soften said polymer layer. The softened now tacky layer was brought into engagement with the photoconductive coating of the photoconductive coating of the member carrying the dry toner image to transfer the toned image to the tacky surface of image receptor 10.

A positive cooling device, such as a thermoelectric cooler may be used or the lamination may be permitted to cool without active external cooling. When the receptor is separated from the recording medium, full transfer of the toner image to the polymer layer is realized, forming an opaque back reflective print copy such as illustrated in FIG. 2. The resulting print copy then is reheated to fix the transferred image permanently by fully embedding said toner image within the resoftened polymer layer, below the outer surface thereof. The said heating also has been found to transparentize the toner pigment.

EXAMPLE 2

An electrophotographic member comprising a substrate carrying a photoconductive coating applied thereto in accordance with the teachings of U.S. Pat. No. 4,025,339 is charged with a negative corona, exposed to the image pattern of an original document projected thereon and toned with a selected toner. If the toner employed comprises a suspension of toner particles in an insulating liquid, a drying step may be required so that a dry toner image is produced.

An 8 mil thick sheet of stainless steel to which has been bonded a 125 micron ($\mu$) thick layer (in dry state) of a thermoplastic polyester resin 14 composition of the following formulation:

7.5 Parts Vitel PE 222
2.5 Parts Vitel VPE 5545A
9.0 Parts Cyclohexanone
0.004 Part Fluorad FC 430 was coated from a solvent solution thereof having 10% solids. The solvent is evaporated to leave the layer of resin bonded to the metal sheet. The thermoplastic polymer-coated paper 12 carrying the resin layer (14) was heated to a surface temperature of 97° to 151° C., the softening temperature of the polymer layer 14, for a duration of 5–10 seconds to soften said polymer layer. The tacky softened layer was brought into engagement with the photoconductive coating of an electrophotographic member carrying the dry toner image and then separated. The toner image adhered to the layer 14. Reheating to about 105° C. fixed the image embedded within the layer without lateral displacement or other distortion or displacement of the toner image.

Using the same formulation of polyester resin as stated immediately above, four separate black toner images were successively transferred from an electrophotographic member to a single sheet of the resin coated substrate, heating the coated sheet after each transfer to embed the image already transferred and also to ready the coated sheet for the next transfer.

Using the same type of polyester coated sheet, separate cyan, magenta, yellow and black toner images were transferred superimposed one after another to a single coated sheet in registry. The transfer temperature involved use of a heated metal roller set at 150° C. Each heating softened the layer 14 and the previously transferred toner image remained undistorted. A final heating, after the four images were transferred superimposed, fixed the overall layered image. The images could not be rubbed out. The properties of the multilayer multicolor print which resulted appeared as described above.

EXAMPLE 3

An electrophotographic member comprising a substrate carrying a photoconductive coating applied thereto in accordance with the teachings of U.S. Pat. No. 4,025,339 is charged with a negative corona exposed to the image pattern of an original document projected thereon and toned with a selected toner. If the toner employed comprises a suspension of toner particles in an insulating liquid, a drying step may be required so that a dry toner image is produced.

A flat specimen of stone, such as marble, to which has been bonded a 125 micron ($\mu$) thick layer (in dry state) of a thermoplastic polyester resin 14 composition of the following formulation:

10 Parts Saran F 310: Copolymer of vinylidene chloride—acrylonitrile resin, Dow Chemical Corp.
90 Parts Cyclohexanone
0.0004 Part Fluorad FC 430 was coated from a solvent solution thereof having 10% solids. The solvent is evaporated to leave the layer of resin bonded to the paper. The thermoplastic polymer-coated paper 12 carrying the resin layer (14) was heated to a surface temperature between 125° and 130° C., the softening temperature of the polymer layer 14, for a duration of 5–10 seconds to soften said polymer layer. The softened layer was brought into engagement with the photoconductive coating of the photoconductive coating of the electrophotographic member carrying the dry toner image to transfer the image from said member to image receptor 10. The engagement was performed by placing the heated image receptor 10 over the image carrier and applying a heated roller thereover. The receptor 10 is peeled off carrying with itself, the toner image. The receptor then is reheated to fix the image embedded in the layer 14 and then cooled.

EXAMPLE 4

An electrophotographic member comprising a substrate carrying a photoconductive coating applied thereto in accordance with the teachings of U.S. Pat. No. 4,025,339 is charged with a negative corona exposed to the image pattern of an original document projected thereon and toned with a selected toner. If the toner employed comprises a suspension of toner particles in an insulating liquid, a drying step may be required so that a dry toner image is produced.

A sheet of plain paper to which has been bonded a 125 micron ($\mu$) thick layer (in dry state) of a thermoplastic polyester resin 14 composition of the following formulation:

10 Parts Polyvinyl Acetate AYAA
90 Parts Cyclohexanone
0.0004 Part Fluorad FC 430 was coated from a solvent solution thereof having 10% solids. The solvent is evaporated to leave the layer of resin bonded to the paper. The thermoplastic polymer-coated paper 12 carrying the resin layer (14) was heated to a surface temperature between 125° and 130° C., the softening temperature of the polymer layer 14, for a duration of 5–10 seconds to soften said polymer layer. The softened layer was brought into engagement with the photoconductive coating of the photoconductive coating of the electrophotographic member carrying the dry toner image to transfer the toner image from said member to said image receptor 10. The engagement was performed by passing the heated image receptor and the image carrier through a nip defined between a pair of rollers, one formed of hard rubber having a durometer hardness of 60–80. The other roller of said pair formed of stainless steel may be heated or may serve merely as a backup roller. The image carrying receptor was again heated to embed the toner and transparentize the pigment.

EXAMPLE 5

An electrophotographic member comprising a substrate carrying a photoconductive coating applied thereto in accordance with the teachings of U.S. Pat. No. 4,025,339 is charged with a negative corona exposed to the image pattern of an original document projected thereon and toned with a selected toner. If the toner employed comprises a suspension of toner particles in an insulating liquid, a drying step may be required so that a dry toner image is produced.

A sheet of plain paper to which has been bonded a 125 micron ($\mu$) thick layer (in dry state) of a thermoplastic polyester resin 14 composition of the following formulation:

10 Parts Butvar B-76 Polyvinyl butyral resin, Monsanto
90 Parts Cyclohexanone
0.004 Part Fluorad FC 430 was coated from a solvent solution thereof having 10% solids. The solvent is evaporated to leave the layer of resin bonded to the paper. The thermoplastic polymer-coated paper 12 carrying the resin layer (14) was heated to a surface temperature between 110° and 115° C., the softening temperature of the polymer layer 14, for a duration of 5–10 seconds to soften said polymer layer. The softened layer was brought into engagement with the photoconductive coating of the photoconductive coating of the electrophotographic member carrying the dry toner image to transfer the toner image from said member to the tacky layer 14 of image receptor 10. Reheating follows with cooling thereafter.

EXAMPLE 6

An electrophotographic member comprising a substrate carrying a photoconductive coating applied thereto in accordance with the teachings of U.S. Pat. No. 4,025,339 is charged with a negative corona exposed to the image pattern of an original document projected thereon and toned with a selected toner. If the toner employed comprises a suspension of toner particles in an insulating liquid, a drying step may be required so that a dry toner image is produced.

A sheet of plain paper to which has been bonded, a 0.75 to 2.0 mil thick layer 14 (in dry state) of polyethylene or polypropylene was coated by hot melt extrusion of either polymer having 100% solids to leave the layer of paper 12 carrying the resin layer 154 was heated to a surface temperature between 110° and 130° C., the melting point range of the layer 14, for a duration of 5–10 seconds to soften said polymer layer. The softened layer was brought into engagement with the photoconductive coating of the photoconductive coating of the electrophotographic member carrying the dry toner image to transfer the image from said member to image receptor 10. One can effect the transfer by passing the heated image receptor and the image carrier through a nip defined between a pair of rollers, one formed of hard rubber having a durometer hardness of 60–80 which functions as a pressure roller. The other roller of said pair formed of stainless steel may be heated or may serve merely as a backup roller.

EXAMPLE 7

In another example of the practice of the invention, an electrophotographic member such as described in U.S. Pat. No. 4,025,339 first is heated to about 125° C. on a platen which is a smooth flat aluminum block of a size corresponding to that of the electrophotographic member. A polyethylene coated paper receptor is then brought into contact and laminated to the heated electrophotographic member by means of a 1 inch diameter hard rubber roller (about 50–80 Durometer A). The roller, under pressure, is rolled across the reverse (uncoated) side of the electrophotographic member in one continuous motion at an approximate speed of 2–5 inches per second. The laminate is removed from the heated platen and the two members are either (1) separated immediately or (2) first cooled to room temperature, or below, before separation. The polyethylene (and polypropylene) coated paper substrates appear to require cooling for best results whereas the polyester resins do not.

EXAMPLE 8

An alternate procedure involves substituting a stainless steel roller, heated to about 125°–150° C., for the rubber roller. In this case, the electrophotographic member is maintained at ambient temperatures, the heat required for image transfer being supplied by the heated metal roller. The laminate is made in the same way as described above by passing the heated roller, under pressure, across the uncoated surface of the image receptor in contact with the plate. The laminate then may be separated immediately or else cooled to ambient temperatures, or below, depending upon the type of resin coating employed. Generally the thickness of each of the multilayers is about 0.5 micron ($\mu$).

Variations are capable of being made in the details of the invention and the methods and processes described without departing from the spirit and scope thereof as defined in the claims which follow. The specific temperatures described may be varied with the polymer compositions employed, the thickness of the polymer coating, the characteristics of the selected substrate and, to some degree, the specific toners used. The application of force or pressure during transfer is not mandatory.

What is desired to secure by Letters Patent of the United States is:

1. A method of forming a print copy of an original image pattern comprising the steps of:

forming a dry toner image of the original image pattern electrophotographically on an electrophotographic medium, providing an opaque substrate carrying a layer of light-transmissive thermoplastic polymer composition bonded to one surface thereof at an interface, bringing the polymer layer and the toner image carrying surface into contact engagement, simultaneously applying heat and pressure to the engaged surfaces, the heating being sufficient to bring the polymer layer to its softening temperature, thereby embedding and transparentizing the toner particles which define the toner image from the toner image carrier within the polymer layer entirely below the surface of said polymer layer and in the absence of relative lateral movement of said toner particles, maintaining the image density, resolution and integrity of the transferred image without loss to form a reflective print of the original image, and thereafter separating the engaged surfaces to recover said reflective print copy, whereby in viewing the reflective print, light passing through the light-transmissive polymer layer and the superimposed toner particles to the interface is reflected diffusingly back through the toner particles increasing the intensity and furnishing brilliance and depth giving the viewer a pseudo three-dimensional image.

2. The method as claimed in claim 1 comprising the step of preheating the receptor and laminating using simultaneous application of pressure and heat.

3. The method as claimed in claim 1 comprising the step of cooling the polymer layer subsequent to lamination.

4. The method as claimed in claim 1 comprising the steps of simultaneously applying heat and pressure to effect the laminate, cooling the receptor after separation for the laminate and subsequently resoftening and simultaneously applying pressure to apply at least an additional toner image in registry to the polymer surface in registry with the prior applied image.

5. The method as claimed in claim 1 in which the polymer layer is formed of a polyester based resinous composition.

6. The method as claimed in claim 1 in which the polymer layer is formed of a polyvinylideneacrylonitrile copolymer based resinous composition.

7. The method as claimed in claim 1 in which the polymer layer is formed of a polyvinyl acetate based resinous composition.

8. The method as claimed in claim 1 in which the polymer layer is formed of a polyvinyl butyral based resinous composition.

9. The method as claimed in claim 1 in which the polymer layer is formed of a polyvinyl based resinous composition.

10. The method as claimed in claim 1 in which the polymer layer is formed of one of polyethylene and polypropylene.

11. The method as claimed in claim 1 in which the polymer layer is formed of a polyvinyl acetate-vinyl chloride copolymer based resinous composition.

12. The method as claimed in claim 1 in which the polymer layer is formed of a blend of polyester resins of similar chemical composition but different molecular weights.

13. The method as claimed in claim 1 in which the polymer layer is formed of a compatible blend of polyester resins with resins of different chemical composition selected from modified phenolic, polyketone or resin esters.

14. The method as claimed in claim 1 in which the substrate layer is a metal.

15. The method as claimed in claim 1 in which the thermoplastic polymer layer is between 4 to 8 microns in thickness.

16. The method as claimed in claim 1 in which the thermoplastic polymer layer is one of polyethylene and polypropolene and is between 0.75 to 2 mils in thickness.

17. The method as claimed in claim 1 in which the thermoplastic polymer layer is heated to a temperature between 97° C. and 151° C.

18. The method as claimed in claim 1 in which the thermoplastic polymer layer is heated to a temperature between 110° C. and 135° C.

19. The method as claimed in claim 1 in which the substrate is selected from the group consisting of paper, metal and resilient material.

20. The method as claimed in claim 1 and the step of reheating the receptor subsequent to said transfer and separation for resoftening the polymer layer.

21. A method of forming a print copy of an original image pattern comprising the steps of:

forming a dry toner image of the original image pattern electrohotographically on an electrophotographic medium, providing a substrate carrying a layer of thermoplastic polymer composition bonded to one surface thereof, heating the polymer layer to its softening temperature thereof, laminating the toner image carrier to the softened polymer layer and separating the laminate to transfer the toner image to the polymer layer, reheating the separated receptor sufficient to soften the polymer layer, and forming additional toner images and transferring each to the softened polymer layer superimposed in registry, each successive transfer being preceded by application of heat to the receiving surface sufficient to soften the polymer layer, the final transfer being succeeded by heating said receptor to fix the images.

22. A method of forming a print copy of an original image pattern comprising the steps of:

forming a dry toner image of the original image pattern electrophotographically on an electrophotographic medium, providing a substrate carrying a layer of thermoplastic polymer composition bonded to one surface thereof, heating the polymer layer to its softening temperature thereof, laminating the toner image carrier to the softened polymer layer and separating the laminate to transfer the toner image to the polymer layer, and heating the separated receptor to soften the polymer layer and applying the successive image to the softened layer under the same conditions as earlier employed.

23. A method of forming a print copy of an original image pattern comprising the steps of:

forming a dry toner image of the original image pattern electrophotographically on an electrophotographic medium, providing a substrate carrying a layer of thermoplastic polymer composition bonded to one surface thereof, heating the polymer layer to its softening temperature thereof, laminating the toner image carrier of the softened polymer layer and separating the laminate to transfer the toner image to the polymer layer, and transparentizing the toner particles by reheating after transfer of the image to the polymer layer.

24. A method of forming a print copy of an original image pattern comprising the steps of:

forming a dry toner image of the original image pattern electrophotographically on an electrophotographic medium, providing a substrate carrying a layer of thermoplastic polymer composition bonded to one surface thereof, heating the polymer layer to its softening temperature thereof, laminating the toner image carrier to the softened polymer layer and separating the laminate to transfer the toner image to the polymer layer, reheating the separated receptor sufficient to soften the polymer layer and transparentize the toner particles, and forming additional toner images and transferring each to the softened polymer layer superimposed in registry, each successive transfer being preceded by application of heat to the receiving surface sufficient to soften the polymer layer, the final transfer being succeeded by heating said receptor to fix the images.

* * * * *